United States Patent [19]

Reagan

[11] 4,103,693

[45] Aug. 1, 1978

[54] HAIR ARRANGING ACCESSORY

[76] Inventor: Rose M. Reagan, 1550 E. 221st St., Euclid, Ohio 44117

[21] Appl. No.: 774,150

[22] Filed: Mar. 3, 1977

[51] Int. Cl.[2] ..... A45D 8/00

[52] U.S. Cl. ..... 132/46 R

[58] Field of Search ..... 132/48 R, 46 R, 367 R, 132/9, 45; 24/81 C, 259 HC, 259 R, 259 FF, 256-257, 129 B, 265 C, 255, 85 R; 2/174, 198; D28/253, 41-43

[56] References Cited

U.S. PATENT DOCUMENTS

| | | | |
|---|---|---|---|
| D. 181,252 | 10/1957 | Hall | D28/42 |
| D. 205,576 | 8/1966 | Day | 132/46 R |
| 1,629,741 | 5/1927 | Schick | 132/45 |
| 1,900,002 | 3/1933 | Varell | 128/163 |
| 2,818,870 | 1/1958 | Francis | 132/46 R |
| 3,724,470 | 4/1973 | Wilson | 132/46 R |

*Primary Examiner*—Louis G. Mancene
*Assistant Examiner*—Gregory E. McNeill
*Attorney, Agent, or Firm*—J. H. Slough

[57] ABSTRACT

A hair arranging accessory in the form of a flattened annulus or band of semirigid sheet material can be opened to receive a strand of hair and compressed to grip the strand. An inside surface portion of the annulus is provided with a gripping surface to inhibit slipping of the strand, and a pin is projected through apertures in the annulus wall and the hair of a user. The accessory affords means to form an instant and secure hairdo as well as a solid, attractive base for attachment of a hairpiece.

10 Claims, 17 Drawing Figures

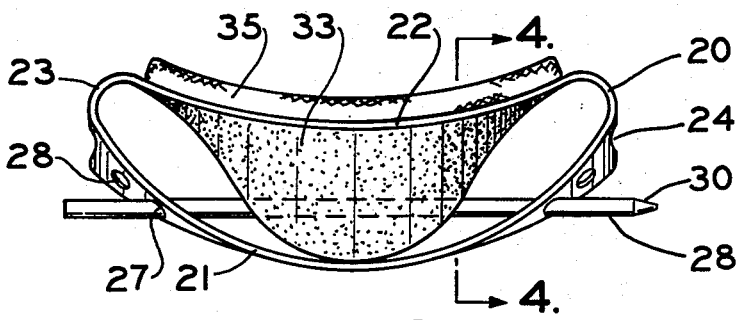
FIG. 2
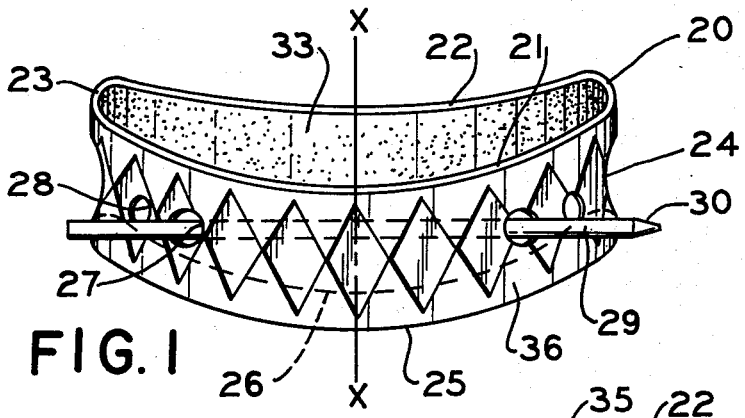
FIG. 1
FIG. 4
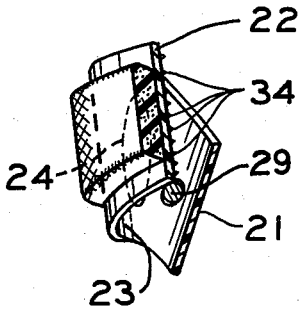
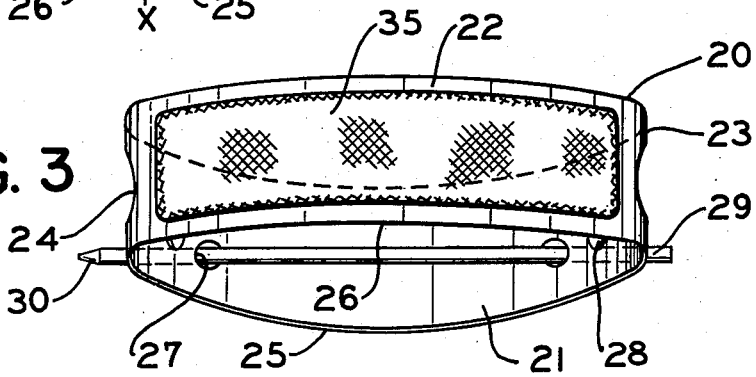
FIG. 3
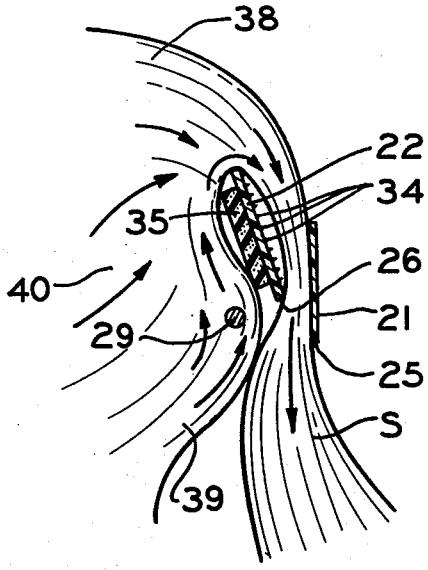
FIG. 5

FIG. 6
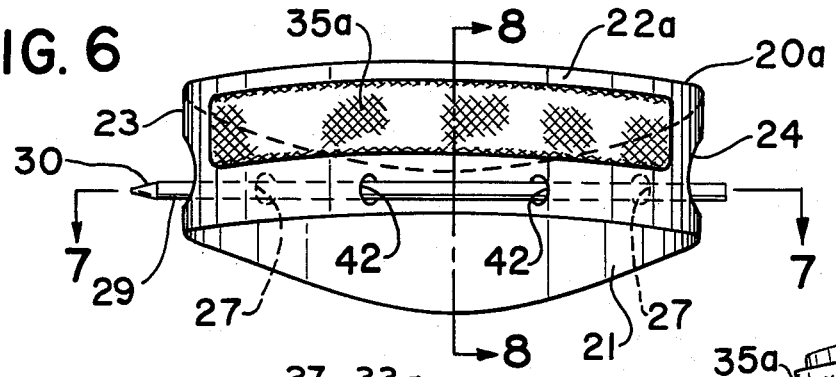
FIG. 7
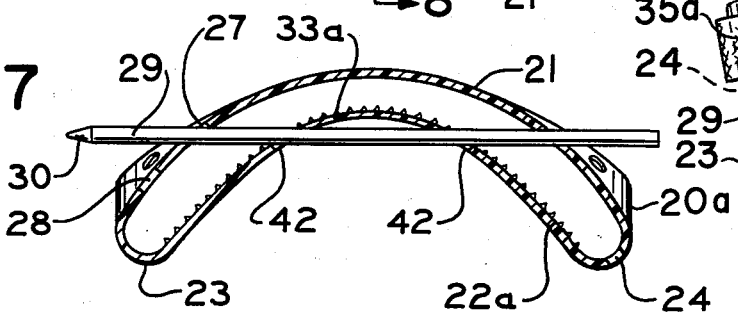
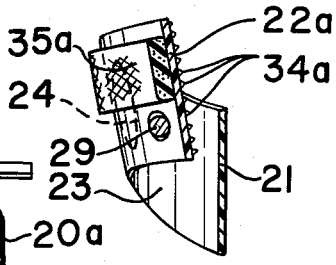
FIG. 8
FIG. 11
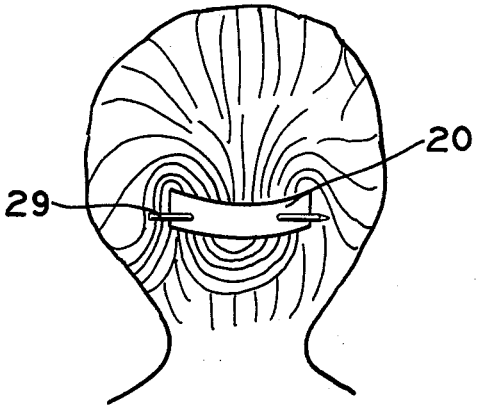
FIG. 9
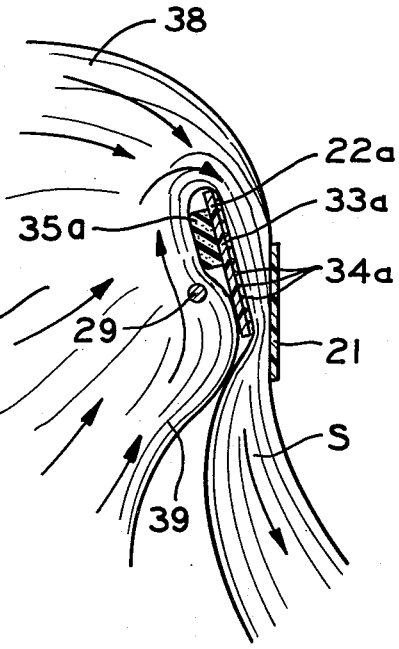
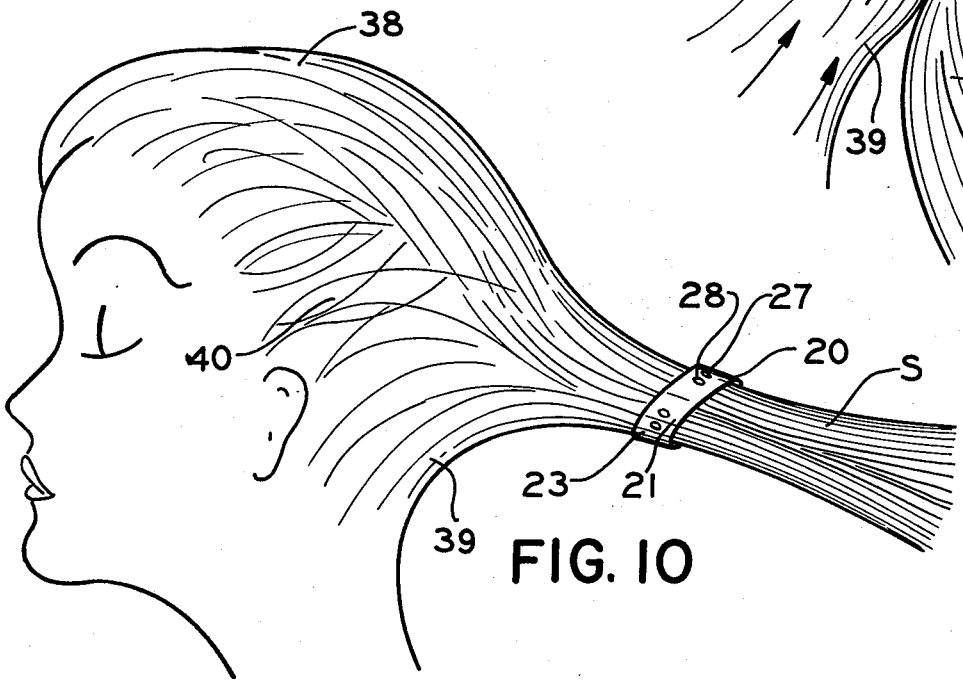
FIG. 10

HAIR ARRANGING ACCESSORY

This invention relates to an article for use in hair styling and control and particularly to a hair arranging accessory and hair fastener.

The present invention is particularly useful for a person having long hair which presents a time consuming problem of management and control. It is frequently necessary for long hair to be held out of the way for purposes of comfort, safety, sports, or variation of the hairdo. A common expedient is to gather the elongated hair at the back of the head and fasten it into a single strand or "pony tail." Articles for facilitating this type of hair arrangement have been the subjects of prior patents. Examples will be found in the following U.S. Pat. No. 971,519 issued to C. A. Brannen Oct. 4, 1910; No. 2,668,547 issued to R. E. Wille Feb. 9, 1954; and No. 2,818,870 issued to O. R. Francis on Jan. 7, 1958. None of these prior inventions or any prior art known to the present inventor disclose an accessory having the features and characteristics of the present invention and which is as versatile and simple to manipulate.

The hair arranging accessory of this invention comprises an annulus or band of flexible sheet material, the annulus being normally flattened and providing front and rear, generally overlapping wall portions. The annulus can be flexed to the open position to receive a large strand or bundle of hair brought together at a desired location on the head and can then be compressed over the strand to retain the hair in place. An inner surface portion of the annulus is provided with gripping means to prevent the annulus from slipping off of the strand, and an elongated pin is projectable through a pair of apertures in the front wall, beneath the lower edge of the rear wall, and through the hair of the user. A second embodiment of the invention differs from the first in that a second pair of apertures is provided in the rear wall which also receives the pin.

An object of the present invention is to provide a hair arranging accessory which enables the user to attain a virtually instant hairdo with minimal manipulation.

Another object of invention is to provide a solid and attractive base for various hair styles and arrangements.

A further object of invention is to provide an accessory which serves both as a hair clip for holding the hair securely against slipping and affords a basic hairdo for creating additional hair styles.

Yet another object of the invention is to provide a hair arranging accessory as set forth above having tactile locating means to aid the user in manipulating the accessory at the back of the head.

Further objects of the invention and the invention itself will be readily understood from the following description of five embodiments thereof illustrated in the accompanying drawings in which:

FIG. 1 is a front view of the hair arranging accessory of the invention;

FIG. 2 is a top plan view of the accessory of FIG. 1;

FIG. 3 is a rear view of the accessory tilted forwardly and downwardly to a small degree;

FIG. 4 is a vertical section taken along the line 4—4 of

FIG. 2;

FIG. 5 is a vertical sectional view of the accessory as applied to the hair at the back of a person's head;

FIG. 6 is a rear view of a second embodiment of the hair arranging accessory of this invention;

FIG. 7 is a horizontal section taken along the line 7—7 of FIG. 6;

FIG. 8 is a vertical section taken along the line 8—8 of FIG. 6;

FIG. 9 is a view similar to FIG. 5 showing the second embodiment of the invention as applied to the hair at the back of the head;

FIG. 10 illustrates the manner in which the accessory of this invention is initially applied to the hair, the accessory being shown on a reduced scale; and FIG. 11 is a back view of the head showing one way of fastening the hair to form a finished hairdo.

Figure 12:
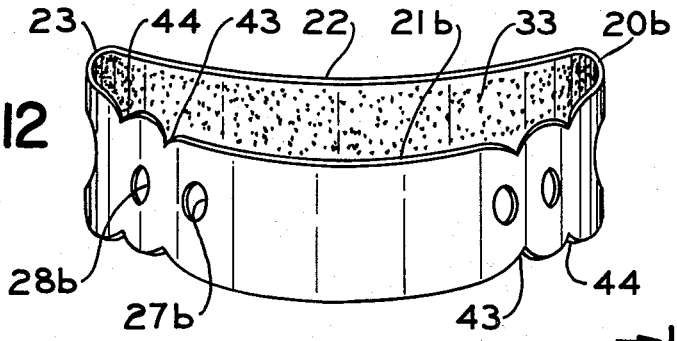
Figure 15:
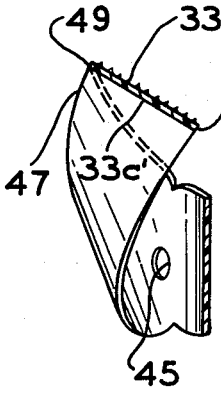
Figure 14:
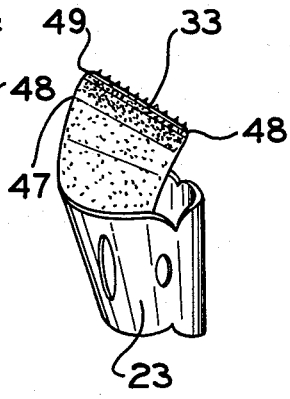
Figure 13:
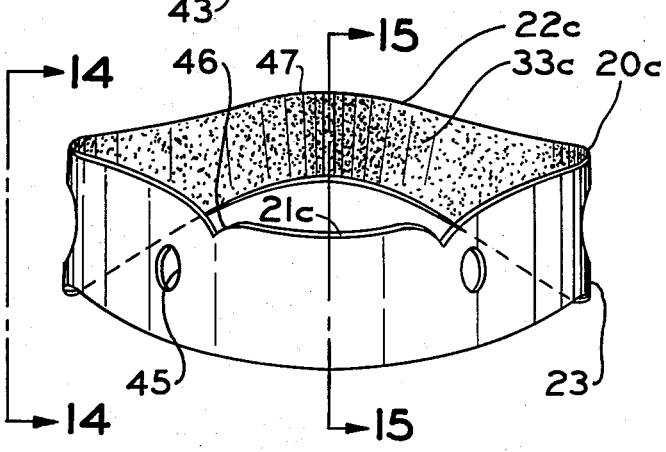
Figure 16:
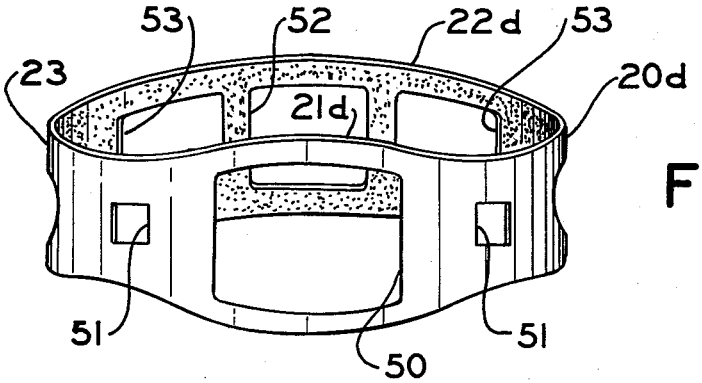
Figure 17:
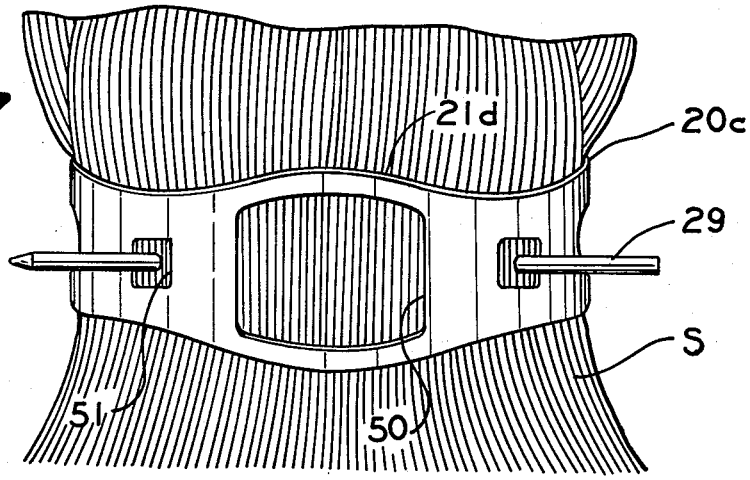

FIG. 12 is a front view of a third embodiment of the hair arranging accessory of this invention;

FIG. 13 is a front view of a fourth embodiment of the hair arranging accessory of this invention;

FIG. 14 is a side view of the accessory of FIG. 13 as viewed from the line 14—14 of FIG. 13;

FIG. 15 is a section taken along the line 15—15 of FIG. 13;

FIG. 16 is a front view of a fifth embodiment of the hair arranging accessory of this invention; and FIG. 17 is a front view of the embodiment of FIG. 16 as applied to a person's hair.

Referring now to the drawings in all of which like parts are designated by like reference characters, the hair arranging accessory of this invention comprises a flattened annulus 20 which may be of any suitable diameter for encircling a person's hair when the hair is brought together in a strand at the back of the head. The annulus 20 is preferably formed of flat, semirigid material. Such material may comprise one of the well-known plastics which has sufficient stiffness to resist distortion in the axial direction of the annulus while having enough flexibility to allow the annulus to be opened for receiving the strand and compressed for gripping the strand. The diameter of the annulus in the horizontal direction and the width thereof in the vertical direction as viewed in FIGS. 1 and 3 may vary, and it is contemplated that the accessory of the present invention would be provided in varying dimensions. As herein illustrated, the annulus has a horizontal diameter of approximately 3½ inches (8.89 cm) and an annulus width of 1inch (2.54 cm).

The annulus 20 is preferably preformed in a somewhat flattened condition thereby providing a front wall portion 21 and a rear wall portion 22 connected by laterally disposed, rounded end wall portions 23. Both the front and rear wall portions 21 and 22, respectively, are preferably provided with a slight initial curvature whereby the annulus conforms generally to the shape of the back of a person's head when said annulus is disposed with the rear wall portion flat against the back of the head and the front wall portion over said front wall portion.

As best seen in FIG. 4, the end wall portions 23 may be provided with relief apertures or slots 24 whereby to afford increased flexibility in the area of said end walls for opening and closing the annulus 20.

The front wall 21 of the annulus 20 preferably curves or dips downwardly as seen in FIG. 1 whereby it is somewhat downwardly offset with respect to the rear wall portion 22. Thus, a lower edge 25 of the front wall portion 21 is disposed below a corresponding lower edge 26 of the rear wall portion 22 although the front wall portion still overlaps a substantial part of the rear wall portion. This relationship is clearly shown in the sectional view of FIG. 4.

Referring particularly to FIGS. 1 and 4, the front wall portion 21 is provided with two pairs of apertures 27 and 28, each said pair being disposed symmetrically in spaced relationship on either side of a vertical center line *x—x* through the annulus 20 as viewed in FIG. 1. The apertures 28 are disposed a short distance inwardly from the end wall portions 23, and the apertures 27 are spaced inwardly of the apertures 28. A straight, elongated pin 29 having a tapered end portion 31 is adapted to project through one of the pairs of apertures 27 or 28 in use of the accessory in a matter herein later to be explained in detail.

The rear wall portion 22 is preferably provided with an inner gripping surface 33 which affords resistance to hair slipping through the annulus 20 when the walls 21 and 22 are brought together to grip the hair. The means providing the gripping surface may comprise protusions 34 projecting outwardly from the inner surface 33 of the rear wall portion 22 or it may comprise a special cloth, mesh, or grid mounted on said inner surface in any suitable way. It is also anticipated that the rear wall portion 22 can be provided with additional padding 35 to provide more of a lift to the hairdo and present a fuller effect at the back of the head. The padding 35 may comprise any suitable padding material and, if desired, may be mounted upon the inner surface 33 of the rear wall 22 and provided with a suitable covering for gripping the hair and preventing it from slipping through the annulus 20.

As shown in FIG. 1, the front wall portion 21 may be provided with a decorative outer surface as indicated at 36 comprising a pattern molded into and/or painted upon said outer wall or any suitable decorative covering attached thereto.

In use of the accessory of this invention, the hair is combed backwardly from the top and sides and upwardly from the nape of the neck into a single strand S which is projected through the top of the annulus 20 as viewed in FIG. 1. As described above, the annulus 20 may be opened to insert the strand S. During this initial step, the pin 29 is not mounted in either pair of apertures 27 or 28 whereby the hair can slip easily through the annulus 20 until said annulus is snug against the back of the head. The user then presses the front and rear wall portions 21 and 22 together with the hair clamped between them, one side of the strand S being disposed against the gripping surface 33. At this point, the vertical axis of the annulus 20 will be generally perpendicular to the back of the head. With the strand S of hair held tightly between the wall portions 21 and 22, the annulus 20 is pivoted downwardly to the position shown in FIG. 5 whereby the aforementioned vertical axis is in the normal, upright position, and the curved front and rear wall portions rest over the back of the head. This motion causes hair from the top of the head, indicated by the numeral 38, and hair from the nape of the neck or the upswept hair, indicated by the numeral 39, to be drawn firmly into place. The hair at the sides of the head, indicated by the numeral 40, tends to drape more loosely but is still fully controlled by the accessory. The tightness of the hair at any point will be dependent upon the pressured used in initially pulling the strand S through the annulus 20 and tightly against the back of the head. As indicated by the arrows A, all of the hair passes over the top of the rear wall portion 22 and downwardly behind the front wall portion 21. With both wall portions held flat against the head, the pin 29 is inserted through one of a pair of apertures 27 and 28 and the strand S, passed under the lower edge of the rear wall portion 22 and under the upswept hair from the nape of the neck, and projected outwardly through the opposite aperture of the same pair. The pin 29 can be passed beneath the rear wall portion 22 by flexing said rear wall portion upwardly, and this adjustment springs the lower edge 26 of said rear wall portion even more tightly against the front wall portion 21. The combination of the tightly gripping front and rear wall portions, the gripping surface 33, and the pin 29 through the tightly upswept hair 39 provides a firm and dependable clasping means for holding the hair swept neatly to the back of the head to form a simple, basic and attractive hairdo.

Once the accessory of this invention is attached as described above, many options are open to the user. Long hair may be allowed to hand downwardly or wrapped in a circle, disposed under the annulus 20, and then repinned by removing the pin 29 and reinserting it in the manner hereinabove described, at the same time engaging the newly wrapped hair. Persons with shorter hair may choose to simply comb or pin the extra hair over the upswept hair 39. The accessory of this invention is also ideal for mounting a wide variety of hairpieces. In creating various hairstyles and arrangements, the pin 29 may be inserted through either pair of apertures 27 and 28, or two pins may be used by inserting one through each pair of apertures.

The second embodiment of the invention as disclosed in FIGS. 6–8 differs from the first invention primarily in that the rear wall is modified whereby it also provides at least one pair of apertures for receiving a pin 29. Thus, the second embodiment comprises an annulus or band **20*a* having a front wall portion 21 and a modified rear wall portion 22*a*. The front and rear wall portions are connected at their lateral ends by end wall portions 23 and the front wall portion 21 is provided with pairs of apertures 27 and 28 substantially as provided in the first embodiment. The rear wall portion 22*a* is provided with at least one pair of apertures 42 which are disposed adjacent to the lower edge of said rear wall portion, indicated at 26*a*. Modified padding 35*a* may be provided above the apertures 42 if desired, and the inner surface of said rear wall portion is provided with a gripping surface 33*a* which may comprise protrusions 34*a*** or any of the other means suggested in connection with the first embodiment.

As shown in FIG. 9, top hair 38, upswept hair 39, and side hair 40 are all brought over the upper edge of the rear wall portion 22 and downwardly through the modified annulus **20*a*. With said annulus held close to the back of the head, a pin 29 is inserted through one of a pair of apertures 27 or 28 and the strand S, through the pair of apertures 42 in the rear wall portion 22*a* at the same time passing beneath the upswept hair 39**, and outwardly through the opposite aperture of the same pair in said front wall portion. From this point, any of the steps suggested in connection with the first embodiment for creating a unique and individual hairstyle, as well as many other steps, may be taken.

The third embodiment of the invention illustrated in FIG. 12 is similar to the first embodiment and comprises an annulus or band **20*b* having a modified front wall portion 21*b* and a rear wall portion 22. The front and rear wall portions are connected at their lateral ends by end wall portions 23, and the front wall portion 21*b* is provided with pairs of apertures 27*b* and 28*b* substantially as provided in the first embodiment. Also, the rear wall portion is preferably provided with an inner gripping surface 33** as in the first embodiment.

The modification to the front wall portion **21*b* comprises pairs of notches 43 and 44 in the upper and lower edges of said front wall portion, said notches providing tactile locating means to help the user locate the apertures 27*b* and 28*b*, respectively. Because of the difficulty of obtaining a direct view of the back of the head by means of a mirror and the additional confusion caused by any such view being a reversed image, it is much simpler and easier for the user to locate the apertures for receiving a pin 29 by means of the sense of touch. Thus by feeling with a fingertip along either the top or bottom edge of the modified front wall portion 21*b* until a notch 43 or 44 is found, the user can quickly learn to locate either the pair of apertures 27*b* or 28*b***.

In the embodiment of FIGS. 13–15, an annulus or band **20*c* has a modified front wall portion 21*c*, a modified rear wall portion 22*c*, and end wall portions 23. The modified front wall portion 21*c* is provided with a single pair of apertures 45 and tactile locating notches 46 for locating the apertures 45**. It will be readily understood that more than one pair of notches and apertures may be provided if desired.

The modified rear wall portion **22*c* differs from previously described wall portions in that it is formed upwardly to provide an arched portion 47 having a lower edge 48 disposed above the upper edge of the front wall portion 21*c* and thrust forwardly of an upper edge 49 of said rear wall portion. In this embodiment, both the front and back wall surfaces are preferably provided with gripping surface means as indicated at 33*c* and 33*c*$^1$. It will be readily understood that the annulus 20*c*** provides an even higher lift and greater rearward extension of the hair than would be obtained by any of the previous embodiments.

FIGS. 16 and 17 illustrate yet another embodiment of the hair accessory invention comprising an annulus **20*d* having a modified front wall portion 21*d*, a modified rear wall portion 22*d*, and connecting end wall portions 23. The modified front wall portion 21*d* has a large, generally rectangular central aperture 50 and a pair of laterally spaced, smaller rectangular apertures 51. The modified rear wall portions 22*d* is provided with three, generally rectangular apertures of substantially the same size, a central aperture 52 and laterally disposed apertures 53 on either side. The lateral apertures 51 of the front wall portion 21*d* are adapted to receive a pin 29 in the manner herein above described in connection with the previous embodiments, said pins either passing under the lower edge of the modified rear wall portion 22*d* or through the laterally disposed apertures 53 in said rear wall portion. Thus the apertures provide for versatility of manipulation and also lighten the annulus whereby, as a practical matter, it can be made of a heavier, thicker material if desired. The large central aperture 50 in the front wall portion 21*d*** also allows a generous portion of the hair to show through the annulus if desired whereby the same can contrast to any flattering color or design which may be provided on said front wall portion.

From the foregoing it will be readily seen that the present invention provides unique and effective means for quickly and reliably creating a simple and attractive hairdo which may provide the basis for any number of hair styling creations.

It will be understood that many changes in the details of the invention as herein described and illustrated may be made without, however, departing from the spirit thereof or the scope of the appended claims.

I claim:

1. A hair arranging accessory for securing a strand of hair gathered together at a predetermined location on the head and providing a base for a hairpiece, said accessory comprising:

a substantially flattened annulus, said annulus having substantially flattened front and rear semirigid wall portions at least partly overlapping each other and of similar slight initial predetermined concavity;

said wall portions being connected to each other at laterally disposed rounded ends;

said accessory adapted to be disposed against the head with said rear wall portion positioned adjacent to the head and an intermediate portion of said front wall portion positioned outwardly and generally downwardly offset with respect to said rear wall portion;

said front and rear wall portions being sufficiently flexible whereby they can be flexed apart to define an opening for projecting the strand therethrough prior to disposing the rear wall portion against the head;

said front wall portion having a pair of apertures spaced inwardly of the ends thereof; and an elongated pin projectable through said apertures, said strand, and the hair of the head to securely fasten the hair.

2. A hair arranging accessory as set forth in claim 1 wherein one of said wall portions is provided with gripping means on the surface thereof facing inwardly of said opening to prevent slipping of the accessory on the strand.

3. A hair arranging accessory as set forth in claim 1 wherein said rear wall portion has a pair of apertures spaced inwardly of the ends thereof and adapted to receive said pin when said pin is projected through the apertures of said front wall portion.

4. A hair arranging accessory as set forth in claim 1 wherein said front wall portion has tactile locating means adjacent to said apertures to aid in locating said apertures for insertion of said pin.

5. A hair arranging accessory as set forth in claim 1 wherein said front wall portion is provided with tactile locating means on at least one edge thereof adjacent to said apertures for locating said apertures and inserting said elongated pin.

6. A hair arranging accessory as set forth in claim 1 wherein said rear wall portion is arched upwardly above the level of the upper edge of said front wall portion, the lower edge of said rear wall portion being thrust forwardly of the upper edge of said rear wall portion whereby to provide a greater lift and rearward extension of the hair at the back of the head.

7. A hair arranging accessory as set forth in claim 1 wherein said front wall portion is provided with an enlarged central aperture for exposing a portion of the hair of the wearer.

8. A hair arranging accessory as set forth in claim 2 wherein said gripping means comprises protrusions projecting from the inner surface of said one wall portion.

9. A hair arranging accessory as set forth in claim 7 wherein said rear wall portion has a plurality of enlarged, lightening apertures therein, at least a pair of said apertures being so located that said pin can be inserted both through said front wall portion and said rear wall portion to secure the hair in place.

10. A hair arranging accessory for securing a strand of hair gathered together at the back of the head, downwardly from the top, around the sides, and upwardly from the nape of the neck, said accessory comprising an annulus having substantially flattened front and rear semirigid wall portions overlapping each other and of similar slight initial predetermined concavity and connected to each other by end wall potions;

said front and rear wall portions being sufficiently flexible to separate and define an opening for projecting the strand therethrough;

said front wall portion having a pair of apertures spaced symmetrically inwardly from the ends thereof;

said rear wall portion provided with gripping means facing inwardly of the opening;

said annulus adapted to be brought snugly against the head whereby said strand can be gripped between said front and rear wall portions and then turned downwardly to a position in which said rear wall portion is flat against the back of the head and said front wall portion overlies said strand and said rear wall portion, all of the hair from said top and sides of the head and nape of the neck passing over the top of said rear wall portion and downwardly through said opening; and an elongated pin projectable through said apertures and strand, beneath the lower edge of said rear wall portion, and under the upswept hair from the nape of the neck to securely fasten the hair.

* * * * *